United States Patent [19]

Winchester et al.

[11] 4,116,430

[45] Sep. 26, 1978

[54] STACKING APPARATUS FOR FLEXIBLE SHEETS

[75] Inventors: Roy E. Winchester, St. Albans; Michael J. Marjoran, Rickmansworth; Roger O'Brien, Watford, all of England

[73] Assignee: De La Rue Crosfield Limited, London, England

[21] Appl. No.: 863,060

[22] Filed: Dec. 21, 1977

Related U.S. Application Data

[63] Continuation of Ser. No. 723,298, Sep. 14, 1976, abandoned.

[30] Foreign Application Priority Data

Sep. 16, 1975 [GB] United Kingdom ..... 37988/75

[51] Int. Cl.[2] ..... B65H 29/24; B65H 29/38

[52] U.S. Cl. ..... 271/177; 214/7; 271/182; 271/196; 271/214

[58] Field of Search ..... 271/177, 182, 178, 179, 271/180, 181, 220, 214, 196, 197, 195; 214/7

[56] References Cited

U.S. PATENT DOCUMENTS

| | | | |
|---|---|---|---|
| 2,991,999 | 7/1961 | Doerner | 271/220 |
| 3,162,437 | 12/1964 | Poland et al. | 271/196 X |
| 3,220,724 | 11/1965 | Von Glahn | 271/177 X |
| 3,511,355 | 5/1970 | Schlaupitz | 198/607 X |

FOREIGN PATENT DOCUMENTS

| | | | |
|---|---|---|---|
| 626,263 | 2/1936 | Fed. Rep. of Germany | 271/177 |

OTHER PUBLICATIONS

Fiehl, M. "Bank Check Stacker", *IBM Technical Disclosure Bulletin*, vol. 3, No. 12, May 1961, p. 1.

*Primary Examiner*—Bruce H. Stoner, Jr.
*Attorney, Agent, or Firm*—Kane, Dalsimer, Kane, Sullivan & Kurucz

[57] ABSTRACT

A flexible sheet stacker is described which includes a support surface disposed substantially at right-angles to a flowline along which flexible sheets are fed in spaced relationship. The support surface is adapted to support in a stack the leading edges of the successive sheets fed along the flowline. The pressure-member is arranged to contact a face of a first sheet fed to the support surface and is thereafter movable away from the flowline against biasing means as sheets are progressively fed to the support surface. A wedge shaped separation member is movable along a substantially rectilinear path in advance of a sheet approaching the support surface, the separation member contacting the face of the stack and maintaining the contact during rectilinear movement of the separation means up to the support surface, a face of the stack being thereby displaced laterally out of the path of the leading edge of the approaching sheet as the sheet is advanced up to the support surface.

7 Claims, 5 Drawing Figures

25
22
24
28
23
6
26
27
17
18
5
39
16
10
32
37
1
36
2
4
12
30
14
3
31
21
11
20
19
4
15
38
29
13
7
8
35
34
33
31
36
32
30

STACKING APPARATUS FOR FLEXIBLE SHEETS

This is a continuation of application Ser. No. 723,298, filed Sept. 14, 1976, now abandoned.

BACKGROUND OF THE INVENTION

This invention relates to apparatus for stacking flexible sheets, for example, sheets of paper, which have been fed seriatim along a flow-line. More specifically, the apparatus is of the type in which the leading edges of the sheets are fed up to a support surface which forms an essential part of a stacking apparatus. In operation, a first sheet is fed by a suitable feeding means along the flow-line to the support surface and the following sheets are added progressively in a direction substantially parallel to the surface of said first sheet thereby to form a stack. To control the build-up of the stack, a yieldable pressure pad member, capable of movement in a direction parallel to said support surface, is provided to engage the exposed face of said first sheet.

To facilitate the delivery of a sheet in a direction across the surface of a stack, various devices are known in the art, for example, a driven roller may be provided in frictional contact with the front face of the stack to define a convergent opening for the receipt of a further sheet. Alternatively, a tined or pocketed wheel may be provided to receive the leading edges of sheets and to convey the sheets to the support surface. In the latter instance a part of the wheel is arranged to pass through a suitable aperture formed in the support surface thereby to strip the sheets from between the tines as the wheel revolves.

Special problems are encountered when it is desired to stack sheets at a very high speed in a reliable manner, for example at a frequency of the order of twenty sheets per second. Further problems are encountered when it is desired to stack sheets that are not in perfect condition, for example the apparatus may be required to stack used banknotes at the output stage of a banknote condition-verifying machine. Such banknotes may be torn or folded and, furthermore, the structure of the paper may have weakened or degraded through use. In these circumstances a specific problem may be created after the delivery of a banknote having a damaged or folded end in so far that the said end may obstruct the passage of a following banknote and prevent the same from contacting the support surface. In the case of flat but torn or worn banknotes the weakened ends thereof may be influenced by air turbulence and their trajectories may be varied and indeterminable with the result that an obstruction is created.

BRIEF SUMMARY OF THE INVENTION

In accordance with the present invention apparatus for stacking flexible sheets fed in spaced relationship along a flowline comprises a support surface disposed substantially at right-angles to the flowline and adapted to support in a stack the leading edges of the successive sheets fed along the flowline, a pressure-member arranged to contact a face of a first sheet fed to the support surface and being thereafter movable away from the flowline against biasing means as sheets are progressively fed to the support surface, and a separation means movable along a substantially rectilinear path in advance of a sheet approaching the support surface, the separation means contacting the face of the stack and maintaining the contact during rectilinear movement of the separation means up to the support surface, the face of the stack being thereby displaced laterally out of the path of the leading edge of the approaching sheet as the sheet is advanced up to the support surface.

Preferably the separation means comprises a wedge-shaped member which is oriented such that each sheet is fed to the support surface with its leading edge following immediately behind the thick end of the wedge as the wedge moves along its rectilinear path.

Preferably the wedge-shaped member is mounted upon a unidirectionally-driven endless belt and is conveniently made up from a plurality of discrete parts longitudinally disposed along the belt.

Preferably the sheets are decelerated as they approach the support surface. The decelerating means may comprise, for example, a finger biased into the flowline to contact and hence retard the sheets. In a convenient arrangement the finger is pivotally mounted and is biased into the flowline by means of an adjustable tension-spring.

Preferably two of the separation means are provided to contact the stack along two distinct parallel paths and the decelerating means contacts a sheet along a substantially central part thereof.

Air jets may act upon the side face of a sheet approaching the support surface so as to deflect the trailing end thereof towards the stack and away from the flowline to further facilitate free passage of the following sheet.

BRIEF DESCRIPTION OF THE DRAWINGS

A non-limiting example of the invention will now be described with reference to the accompanying drawings of which.

Figures 1, 1A:
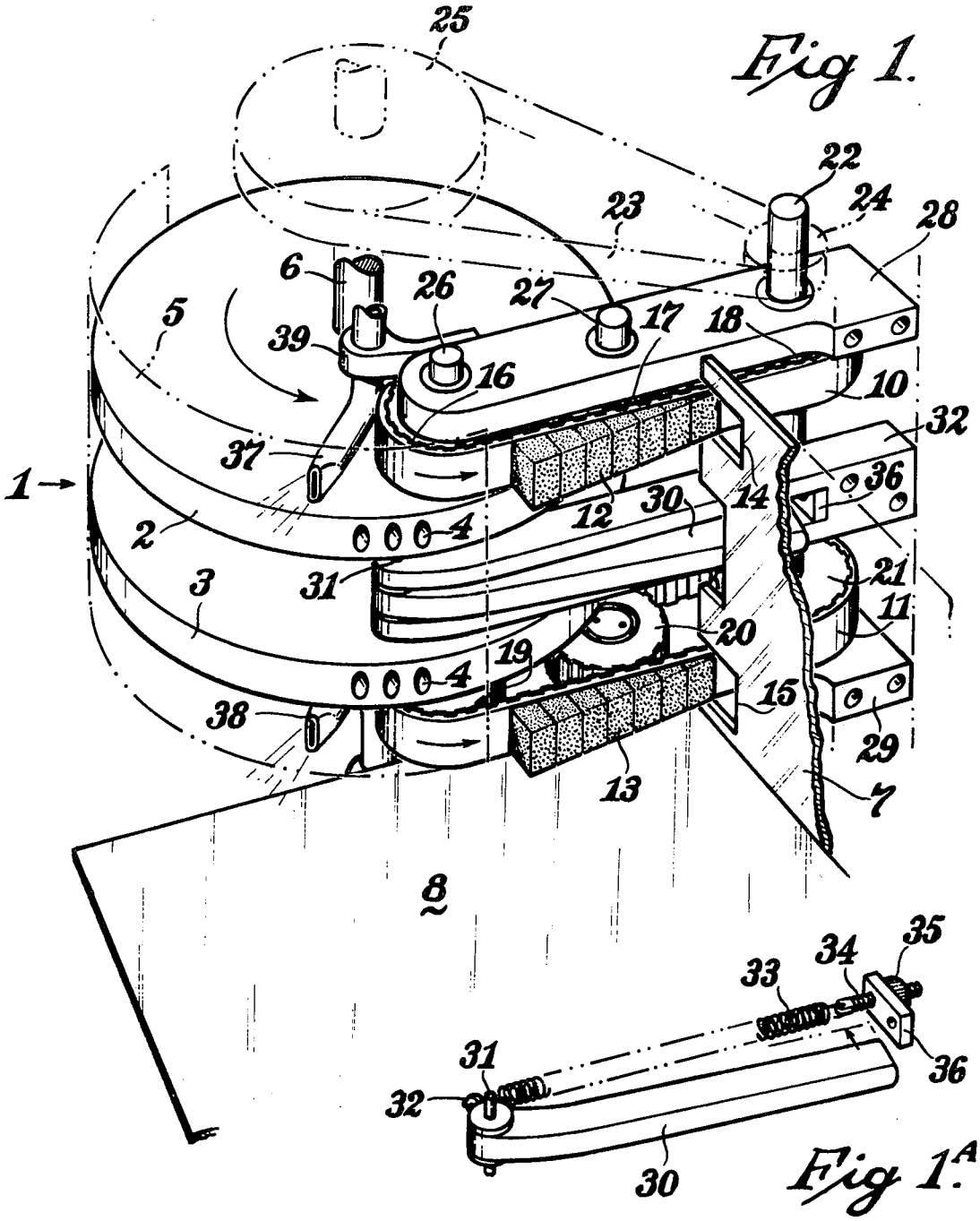
FIG. 1 is a perspective view of the principal parts of a sheet stacking mechanism for stacking sheets on edge.

FIG. $1^A$ shows a part of the mechanism included in FIG. 1; and

Figure 2:
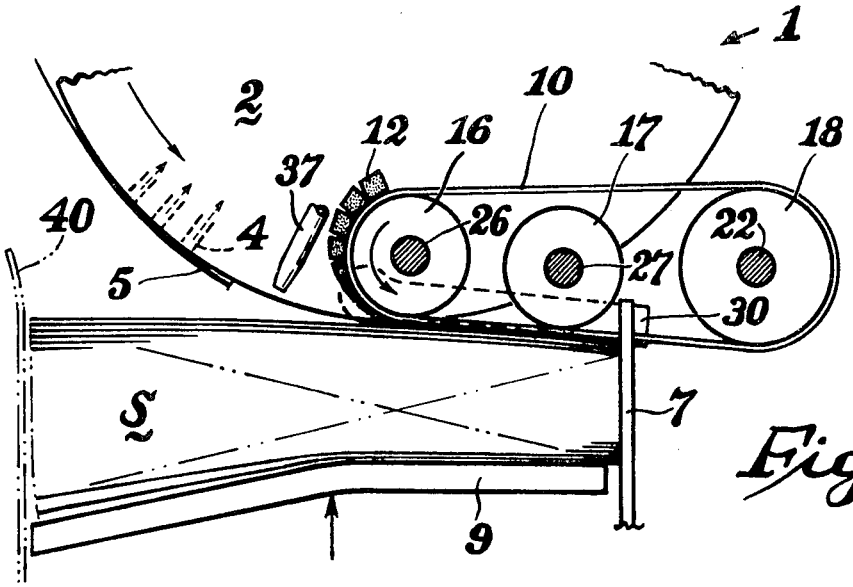
Figure 3:
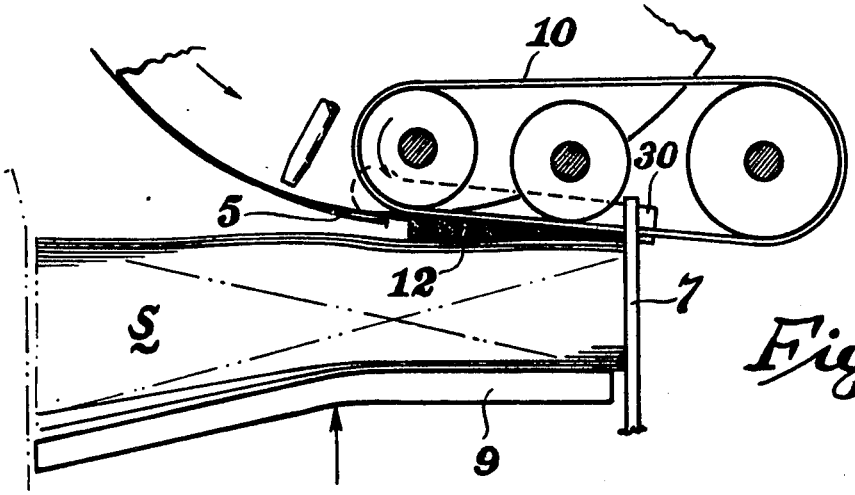
Figure 4:
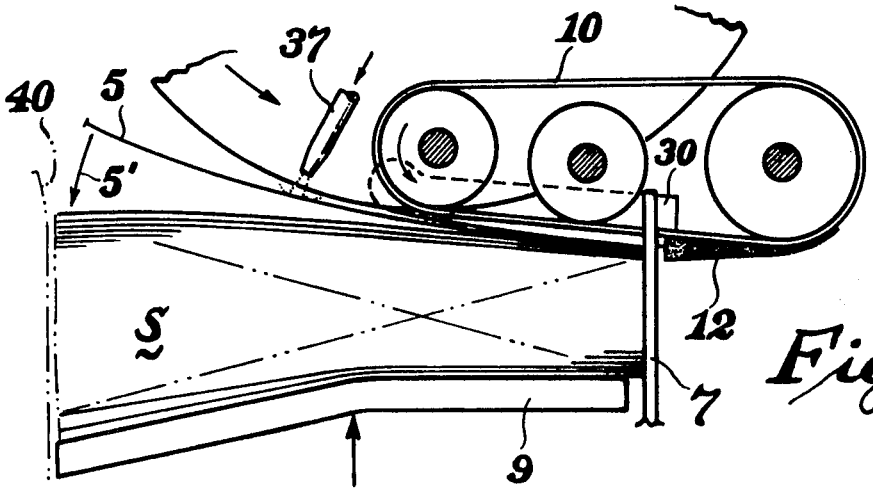

FIGS. 2, 3 and 4 are fragmentary plan views showing three sequential operating positions of the mechanism.

All the drawings are schematic and only parts necessary for the understanding of the invention have been included for reasons of clarity. It should also be appreciated that frame-members, gearing systems and driving means which are of well known types have been omitted.

DETAILED DESCRIPTION

The example relates to an apparatus for stacking document-size sheets delivered one at a time from a transportation flowline, the ultimate member of which comprises a vacuum transporting drum, generally indicated by symbol 1. The drum is formed of two spaced-apart disc members 2 and 3 each having an array of radially disposed vacuum ports 4, for gripping the face of a document, shown in FIG. 1 as a chain-dotted outline 5. A further similar set of ports is provided in the discs at 180° to those illustrated, thereby to enable the drum to handle two documents per revolution. The drum, which is mounted on a vertical shaft 6, is rotated in an anti-clockwise direction at 600 RPM and accordingly delivers twenty documents per second to the stacking means described below. Vacuum is applied to the ports by means of a stationary commutator device (not shown) which is phased in such a manner that when the ports 4 of the drum attain the position shown in FIG. 1 the supply of vacuum is cut off thereby to release the leading end of the document.

Further vacuum ports (not shown) are provided in the drum to grip intermediate zones of the document.

The stack support means comprises a vertical plate member 7 disposed at one end of a horizontal base plate 8, to support the ends and longitudinal edges of the documents in the stack, respectively.

Documents released by the drum are delivered sequentailly to the surface of the plate member 7, thereby to build-up a stack S (FIGS. 2–4). The rear face of the stack is supported by means of a yieldable pressure pad member 9 spring-biased towards the vacuum drum 1.

Disposed outwardly of each of the discs 2 and 3, and in tangential alignment therewith, are provided upper and lower internally notched endless belts 10 and 11 upon which are mounted elongated separation members 12 and 13, respectively, the members being made of plastics material and capable of protrusion beyond the peripheries of the discs.

The belts are driven in the same direction as the discs, and the separation members 12 and 13 are of divergent wedge configuration with respect to their direction of travel, when viewed in plan. To provide flexibility, the separation members 12 and 13 are constructed from separate transverse sections which abut together to form collectively a pair of inclined planes when the belts are travelling along rectilinear paths.

The belts are spaced apart in such a manner that the separation members 12 and 13 engage and slide across the front face of the stack across two parallel paths near the side edges thereof, and to permit the separation members to pass through the vertical support plate 7, slot openings 14 and 15 are formed therein as shown in FIG. 1.

The upper and lower belts are carried upon upper and lower sets of castellated pulleys 16, 17 and 18, and 19, 20 and 21, respectively, which collectively define substantially parallel linear paths for the belts. The belts are driven at a speed substantially equal to the peripheral speed of the discs 2 and 3, and in the direction indicated by the arrows, by means of the pulleys 18 and 21 which are fixedly mounted to a common vertical shaft 22. The shaft 22 is in turn driven by a further belt 23 and pulley system 24, 25 (shown in chain-dotted outline), from the driven shaft 6 upon which is mounted the vacuum drum 1. The ratio of the pulleys in the system is arranged to provide two complete excursions of the separation members 12 and 13 per revolution of the drum 1, and the phasing therebetween is so arranged that the trailing ends of the separation members are slightly in advance of the leading edge of a document when entering the stack, (see FIGS. 1 and 3). Pulleys 16 and 17 of the upper set of pulleys are carried upon stub-shafts 26 and 27, which are in turn mounted upon a horizontal plate 28 rigidly attached to the structure of the apparatus. The pulley 17 thereby serves to guide and support the upper belt 10 against thrust from the stack created by the pressure pad member 9. Similar stub-shafts (not shown) mounted upon a second horizontal plate, the end of which is indicated by symbol 29, are provided to guide and support the lower belt 11.

Disposed between the discs 2 and 3 there is provided a pivotally mounted spring-biased finger member 30 adapted to protrude into the flow-line thereby to contact the central portions of documents approaching the vertical stack-support-plate 7. The finger member 30 is pivoted upon a vertical pin 31 and is lightly biased in a clockwise direction thereby serving to decelerate the documents and prevent the rebounding of the same after they contact the plate 7.

The opposite ends of the pin 31 are mounted in the bifurcated extremities of a support bracket 32 rigidly attached to the structure of the apparatus. The means for biasing the finger member 30 will now be described with reference to FIG. 1[4]. Integrally formed with the pivotal end of the finger there is provided an arm 32 drilled to receive the free end of a tension-spring 33, the opposite end of which is anchored to the structure of the apparatus by means of a screwed rod 34, a knurled nut 35 and a plate 36 secured to the support bracket 32 (FIG. 1). It will thus be seen that the effective pressure of the finger member 30 upon documents approaching the support plate 7 may be readily adjusted by rotation of the knurled nut 35.

To reduce the possibility of the trailing end of a document arriving at the front of the stack from obstructing the leading end of the following document, air jet means are provided to act upon the trailing end. These means comprise air outlet nozzles 37 and 38 disposed adjacent the sides of the discs 2 and 3 in communication with a source of compressed air. The nozzles, which are supported on brackets 39 are angled in such a manner so as to direct jets of air towards the end of the front face of the stack as shown and hence ensure that the trailing end of each document is forcibly moved towards the stack after its release from the vacuum transporting drum 1.

To assist in maintaining the alignment of documents delivered to the support surface 7, a longitudinal stop-plate 40 is provided. Means, (not shown) are provided to alter the positions of the support 7 and the stop-plate 40 to enable the apparatus to be adjusted to accommodate documents having different longitudinal lengths.

Operation of the Apparatus

In FIG. 2 a document 5, adhered to the periphery of the vacuum drum 1, is seen approaching the front face of the stack S, and the leading ends of the separation members 12 and 13 are seen making contact with the front face.

Movement of the belts 10 and 11 thereafter causes the separation members fully to engage with, and slide across, the front face of the stack. This effectively serves to compress the documents within the stack and repels the front face of the stack away from the vacuum drum 1, thereby to permit free entry of the leading edge of the document 5, (see FIG. 3).

Further movement of the belts causes the separation members to pass across and beyond the front face of the stack via the slot openings 14 and 15 of the support plate 7, and the leading edge of the document follows in close pursuit within the temporary space formed between the stack and the vacuum drum 1. During its travel, the central zone of the document slides across the face of the spring-biased finger member 30 which serves to decelerate the document before its eventual arrest by the vertical support plate 7. Thereafter, the front of the stack returns to its initial forward position against the document 5 and finally the trailing end thereof, assisted by the air jets 37 and 38, moves to contact the stack (see arrow 5' in FIG. 4). The documents are delivered to the stacking mechanism at a rate of twenty per second and accordingly their trailing ends are centrifugally ejected from the drum 1 towards the stack. It will therefore be realised that the air jets serve to accelerate this movement thereby reducing the possibility that the said trailing ends will obstruct following documents approaching the stack. Alternative means may be provided to effect an equivalent result, for example, fixedly mounted tapered protrusions may be provided on the periphery of the drum 1 to contact and deflect the trailing ends of the documents after their release by the suction ports.

Whilst only a single alignment plate 40 is shown in FIGS. 2–4 to control the trailing ends of the sheets entering the stack, further devices well known in the art of sheet handling may be provided to maintain transverse alignment of the sheets.

It will be appreciated that by the provision of the above described separation means, mutilated or worn documents may be stacked at high-speed without jamming, and that the problems associated with known stacking apparatus have been substantially eliminated.

We claim:

1. Apparatus for stacking flexible sheets comprising:

a sheet transporting drum comprising a pair of axially aligned discs, each having in its periphery at least one vacuum port in communication with a source of suction to grip and propel a sheet;

a driving means to rotate said drum;

first and second endless belts carried upon respective first and third pulleys of equal diameter disposed wholly within an area bounded by an axial projection of said drum and having an axis offset with respect to the axis of the drum and upon respective second and fourth equal-diameter pulleys disposed at least partially outside said area, said first, second, third and fourth pulleys being sited so that a rectilinear part of each of the belts defines a delivery flow-line for the sheets substantially tangential to the periphery of the drum;

means for driving said belts at substantially the same speed as the peripheral speed of the transporting drum;

a support surface disposed substantially at rightangles to said flow-line and adapted to support in a stack the leading edges of successive sheets fed along said flow-line;

a pressure-member arranged to contact a face of a first sheet fed to said support surface;

biasing means acting on said pressure-member, said pressure-member being movable away from said flow-line against the bias of said biasing means as the sheets are progressively fed to said support surface;

a wedge-shaped separation member attached to the external surface of each of the said belts and protruding so as to overlap the flow-line, each wedge-shaped separation member being arranged to move along said rectilinear delivery flow-line in advance of the leading edge of a sheet propelled by the drum and fed into the flow-line and being oriented with respect to the flow-line such that said leading edge of the sheet follows immediately behind the thick end of the wedge-shaped member, said separation member thereby displacing sheets already in said stack and creating a space for receiving the leading edge of said drum-propelled sheet up to said support surface; and an elongate retardation means having one end located between the two drum discs and between the two endless belts and the other end biased towards the flow-line and so arranged that a sheet approaching the support surface contacts said retardation means after the face of the stack is moved out of the path of the sheet by said wedge-shaped separation members.

2. The invention in accordance with claim 1 wherein each of said separation members comprises a plurality of discrete parts longitudinally disposed along said belt, each part being mounted upon said belt and said parts collectively defining an elongated body.

3. The invention in accordance with claim 1 wherein the elongate retardation means is a pivotally mounted finger biased by a tension spring, one end of said tension spring being fixed and the other end being adaped to create a turning moment to said finger.

4. The invention in accordance with claim 3 wherein means is provided for adjusting the position of said fixed end of said tension spring thereby correspondingly to adjust the biasing force of said finger upon a sheet.

5. The invention in accordance with claim 1 wherein said retardation means is positioned so as to decelerate a sheet by making contact therewith along a substantially central part thereof.

6. The invention in accordance with claim 1 wherein means is provided for deflecting away from the drum and towards the stack the trailing end of said sheet propelled into said space.

7. The invention in accordance with claim 6 wherein said deflecting means comprises an air jet for directing the compressed air upon a side face of the trailing end of said sheet approaching said support surface.

* * * * *